US008322832B2

(12) United States Patent
Emerton et al.

(10) Patent No.: US 8,322,832 B2
(45) Date of Patent: Dec. 4, 2012

(54) INK SUPPLY SYSTEM

(75) Inventors: Neil Emerton, Redmond, WA (US); Andrew Benjamin David Brown, Cambridgeshire (GB); John Lawton Sharp, Cambridgeshire (GB)

(73) Assignee: Tonejet Limited., Melbourn, Royston, Hertfordshire ( * ) Notice: Subject to any disclaimer, the term of this patent is extended or adjusted under 35 U.S.C. 154(b) by 616 days.

(21) Appl. No.: 12/440,598

(22) PCT Filed: Sep. 21, 2007

(86) PCT No.: PCT/GB2007/050567
§ 371 (c)(1),
(2), (4) Date: Mar. 10, 2009

(87) PCT Pub. No.: WO2008/035120
PCT Pub. Date: Mar. 27, 2008

(65) Prior Publication Data

US 2009/0322831 A1 Dec. 31, 2009

(30) Foreign Application Priority Data

Sep. 22, 2006 (GB) ..... 0618620.9

(51) Int. Cl.
*B41J 2/175* (2006.01)
*B41J 2/17* (2006.01)

(52) U.S. Cl. ..... 347/85; 347/84

(58) Field of Classification Search ..... 347/84, 347/85, 89, 92
See application file for complete search history.

(56) References Cited

FOREIGN PATENT DOCUMENTS

| | | |
|---|---|---|
| EP | 1092548 A2 | 9/2000 |
| EP | 1 092 548 | 4/2001 |
| WO | WO 2006/030235 | 3/2006 |
| WO | WO 2006064036 A1 * | 6/2006 |

* cited by examiner

*Primary Examiner* — Matthew Luu
*Assistant Examiner* — Renee I Wilson

(57) ABSTRACT

An ink management system for supplying or receiving liquid at a controlled pressure, comprising: a closed reservoir; a weir disposed in the reservoir, configured to separate the reservoir into a first and a second chamber; the first chamber having an inlet for receiving liquid from a first remote location; and the weir being disposed such that the level of liquid in the first chamber can be maintained at a constant height; wherein the reservoir is sealed from the surrounding atmosphere and the system further comprises a pumped outlet disposed in the second chamber and arranged to remove liquid and gas contained within the reservoir.

14 Claims, 1 Drawing Sheet

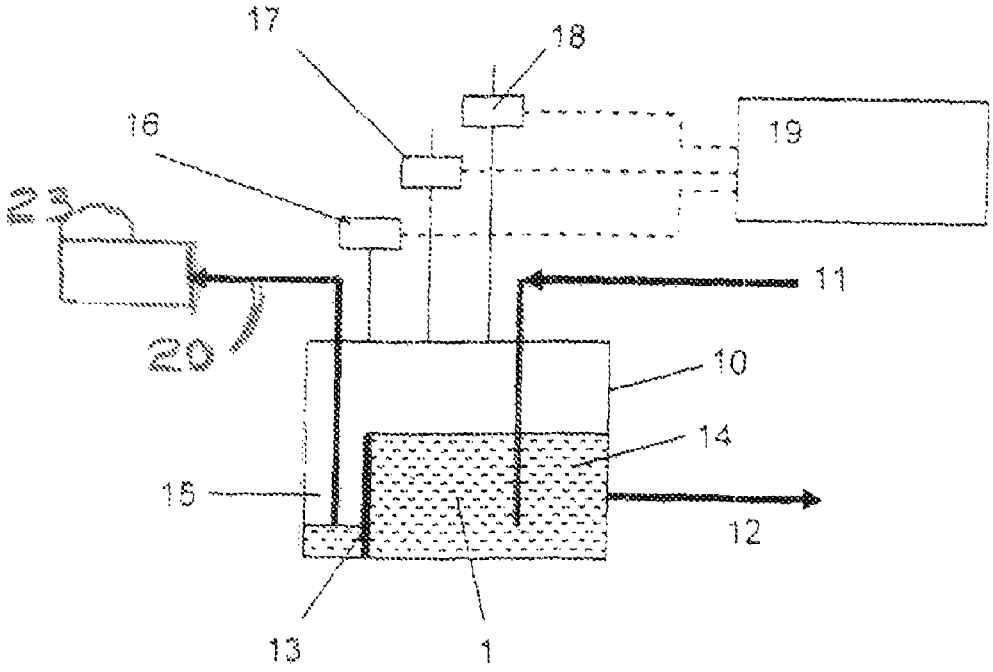
17
18
16
19
23
11
20
10
14
15
12
13
1

INK SUPPLY SYSTEM

The present invention relates to an ink supply system for an inkjet printer. In particular the present invention relates to an ink supply system that enables the pressure of the supplied ink to be varied in order to prime a printhead and in which the supply of ink can be provided at a controlled pressure to the ink ejection location.

In an inkjet printer, in order to achieve consistent ejection of ink from the printhead, precise control of the static pressure of ink is required at the ejection location. In a printhead such as described in EP 1224079 and EP 1366901 precise control of the ink flow is also required. Experience has shown that the pressures at the printhead described in EP 1224079 and EP 1366901 need to be correct to about ±20 Pa and those periodic variations must be below about ±2 Pa to eliminate visible variations in print quality.

A simple method of controlling the pressure of the ink supplied to a printhead is to use gravity. An ink reservoir, whereby the surface of the ink is open to atmospheric pressure, is mounted either above or below the level of the printhead in order to generate a positive or negative ink pressure, as required by the printhead. The required inlet pressure at the ejection location can be set by mechanically adjusting the relative height of the ink reservoir with respect to the printhead. The reservoir may also be supplied with ink by a pump.

Some inkjet printers require ink to flow continuously through the printhead and this requires the printhead to have both an inlet and an outlet to allow ink to flow in and out of the printhead. In these printers the pressure of the ink at this outlet can also be controlled by gravity by allowing ink to flow to atmospheric pressure from the outlet tube to a defined level below the printhead. This level can also be mechanically adjusted to achieve the correct operating conditions (such as ink pressure and flow rate) at the ejection location.

Known disadvantages of a gravity-fed system are:

- Changing the pressures requires physical movement of the reservoirs.
- The location of the reservoirs is determined by the required pressures.
- A large volume of space may be required to accommodate the total adjustable range of the reservoirs.
- Priming printheads with ink can be assisted by supplying ink at pressures that are very different from the pressures required during printing. With a gravity-fed system a large amount of space and typically a significant amount of time is required to move the reservoirs to achieve these pressures.
- The surface of the ink must be open to the atmosphere, increasing the risk of dust or other contaminants polluting the ink.

WO 97/44194 and EP 1092548 describe ink supply systems in which the ink is maintained at a constant level or height in the reservoir by use of a weir; however, these systems all use gravity to set the pressure at the ejection location.

WO 2006/030235 describes a system where the pressure of the ink at the inlet and outlet of a nozzle containing fluid supply apparatus is controlled by controlling the pressure of the air above a weir at the inlet and the outlet from the nozzle containing fluid supply apparatus. In order to maintain the functioning of the weir it is necessary to remove the ink that has flowed over the weir from the reservoir.

WO 2006/030235 describes how this can be done by allowing the ink to be sucked back to the main ink tank through a flow restriction by lowering the pressure of the ink in the main ink tank. However, the rate at which ink is drawn from the reservoirs into the main ink tank will depend on the position of the ink tank relative to the reservoirs, which will require the amount of restriction to be compensated to account for this. In addition, the rate at which ink is drawn from the reservoirs into the main ink tank will depend on whether gas or ink is passing through the flow restriction at any particular moment. This fluctuation in flow rate will tend to lead to fluctuations in the pressure in the reservoir unless the pressure is controlled very carefully with a control system with a very short response time.

In order to avoid this problem a method using floats is presented in WO 2006/030235. The height of these floats is monitored using sensors, thus avoiding the over flow from being drained insufficiently quickly or air being withdrawn. However including floats and sensors increases the cost of the system and can introduce additional failure mechanisms.

In the present invention a method is presented of extracting the fluid that has flowed over the weir in a manner that does not introduce the reliability issues associated with floats being included in the chambers.

According to the present invention there is provided an ink management system for supplying or receiving liquid at a controlled pressure, comprising:

- a closed reservoir;
- a weir disposed in the reservoir, configured to separate the reservoir into a first and a second chamber;
- the first chamber having an inlet for receiving liquid from a first remote location; and
- the weir being disposed such that the level of liquid in the first chamber can be maintained at a constant height;
- wherein the reservoir is sealed from the surrounding atmosphere and the system further comprises a pumped outlet disposed in the second chamber and arranged to remove liquid and gas contained within the reservoir.

The advantage of having a reservoir with a weir that is independent of the surrounding atmosphere is that the pressure of the ink can be controlled by adjusting the pressure of the gas over the surface of the ink without having to adjust the height of the reservoir or weir. Controlling the pressure of the gas may involve a pressure sensor, an actuator and some control electronics arranged in an active feedback loop to control the pressure.

The first chamber may further comprise an outlet for supplying liquid to a second remote location.

The system may further comprise means for controlling a pump attached to the pumped outlet such that the pressure within the reservoir is controlled.

The system may further comprise an additional pump arranged, in use, to pump gas into or out of the reservoir. The system may further comprise means for controlling the additional pump such that the pressure within the reservoir is controlled.

The system may further comprise an orifice connecting the reservoir to a gas at above, below, or at atmospheric pressure configured to bleed gas, in use, into or out of the reservoir. The system may further comprise means for controlling the orifice such that the pressure within the reservoir is controlled.

An inkjet printer may be provided including the ink management system and including a printhead supplied with liquid from the ink management system. The printhead may be the first remote location. The printhead may be the second remote location.

An inkjet printer may be provided including two ink management systems wherein one system supplies liquid to a printhead and the other system receives liquid from the printhead, thereby controlling the pressure of the liquid supplied to the printhead and the pressure of the liquid removed from the printhead, such that the ink flows through the printhead at a controlled rate and at a controlled pressure.

The present invention is further advantageous because:

No mechanical movement of the reservoirs is required.

The location of the reservoirs is not constrained by the required pressures.

The system can be compact because space is not required to accommodate the movement of the reservoirs.

Priming the printhead and purging the printhead and ink system of air is simpler as the pressure can be rapidly and controllably increased and decreased over a large pressure range.

The sealed reservoir prevents dust and other contaminants from reaching the ink.

An example of the system of the present invention will now be described with reference to FIG. 1 in which is shown a cross section of the system.

FIG. 1 shows an ink reservoir 10 which is supplied with ink 1 from a remote location (not shown) through an inlet pipe 11. Ink exits the bottom of the reservoir via an outlet pipe 12 to a print head (not shown). Disposed in the reservoir 10 is a weir 13 which separates the reservoir into a first chamber 14 and a second chamber 15. Ink is pumped into the first chamber 14 through the inlet pipe until it reaches the height of the top of the weir 13 at which point it flows over the weir 13 into the second chamber 15. The fixed height of the weir fixes the volume of ink in the first reservoir and the vertical displacement between the surface of the ink and the ejection location. Ink is removed from the second chamber 15 by a pump 23 for pumping the ink through an overflow return line 20. This may be accomplished by a separate or additional pump and a control (not shown). It should be apparent that alternatively, the pump 18 and control 19 shown in FIG. 1 may also be used for this purpose. The overflow return line is configured to pup both ink and gas from the second flow chamber 15.

The air pressure in the reservoir 10 above the surface of the ink is also controlled and can be measured by a pressure sensor 16. Air can be either bled into or out of the reservoir 10 through an air bleed valve 17 (which can be supplied with air at any given pressure) or it can be pumped in or out of the reservoir by a pump 18 to maintain the pressure in the reservoir at a set point. The air pressure above the surface of the ink in the reservoir 10 can be controlled and set at a desired set point by control electronics 19, or programmed via a computer (not shown). Although air is described in this example, any other suitable gas may be used.

The reservoir 10 can also be configured such that the pump 18 is not required to control the air pressure above the surface of the ink. In this example, the rate of pumping on the overflow return line 20 is greater than the rate at which ink is supplied into the second chamber 15 of the reservoir 10 as it flows over the weir 13. Therefore, both ink and air will always be pumped out of the reservoir 10. This will reduce the pressure of the air in the reservoir 10. The pressure in the reservoir 10 can then be controlled by bleeding air through the air bleed valve 17 into the reservoir 10 in order to maintain the pressure at the desired set point. This example, without the pump 18, results in a system which is less complex since it has fewer parts and will therefore be more reliable.

Owing to the design of the reservoir 10, the ink in the reservoir is kept in constant motion which causes gentle agitation within the ink that some systems require to maintain good dispersion of insoluble materials in the ink, such as pigments.

The control of the air pressure in the reservoir 10 allows the reservoir to be mounted close to the printhead, eliminating the need for long lengths of tubing. This results in a more compact print system that could also be scanned along with a scanning printhead, for example.

In some inkjet systems, a single reservoir (as shown) is sufficient; however, other systems require ink to flow around the printhead and for this two reservoirs are required. In a gravity-fed, two-reservoir system one reservoir receives ink from the printhead and needs to be placed at a level below the ejection location and one reservoir supplies ink to the printhead and needs to be placed at a level above the other reservoir. In the system of the invention, both reservoirs can be set at the desired pressures by changing the pressure of the gas in the reservoir regardless of their location. Therefore, it is not necessary to maintain the two reservoirs at precise heights relative to the printhead. Furthermore, in the two-reservoir system, the flow through the printhead can be reversed easily by adjusting the pressures within each reservoir.

In a particular example, the reservoir is used to feed ink to a printhead at a pressure of −50 Pa. The reservoir is mounted approximately 150 mm above the printhead and the air pressure in the reservoir is approximately −1550 Pa relative to atmospheric pressure. Ink is pumped into the inlet reservoir at 25 ml per min and ink and air are pumped from the overflow at 30 ml per min. Ink flows from the reservoir into the printhead at around 20 ml/min. The pressure in the chamber is monitored and the flow of air into the chamber is controlled with an electronically controlled orifice to maintain the desired pressure. The measurement frequency of the control circuitry is 10 kHz and the actual response time is better than 10 ms, allowing the pulses from the ink supply and ink overflow pumps to be smoothed out to within ±5 Pa. The volume of ink within the reservoir at any one moment is 1.8 ml, and the volume of air is 2.4 ml.

The invention claimed is:

1. An ink management system for supplying or receiving liquid at a controlled pressure, comprising:

a closed reservoir;

a weir disposed in the reservoir, configured to separate the reservoir into a first and a second chamber;

the first chamber having an inlet for receiving liquid from a first remote location; and the weir being disposed such that the level of liquid in the first chamber can be maintained at a constant height;

wherein the reservoir is sealed from the surrounding atmosphere, and wherein the system further comprises a pumped outlet disposed in the second chamber at a position between the level of the weir and the bottom of the second chamber and thereby arranged to remove liquid and gas contained within the reservoir and to define the level of liquid in the second chamber in use.

2. A system according to claim 1, wherein the first chamber further comprises an outlet for supplying liquid to a second remote location.

3. A system according to claim 1, further comprising a pump attached to the pumped outlet; and means for controlling the pump such that the pressure within the reservoir is controlled.

4. A system according to claim 1, wherein the system further comprises an additional pump arranged, in use, to pump gas into or out of the reservoir.

5. A system according to claim 4, further comprising means for controlling the additional pump such that the pressure within the reservoir is controlled.

6. A system according to claim 1, further comprising an orifice connecting the reservoir to a gas at above, below, or at atmospheric pressure configured to bleed gas, in use, into or out of the reservoir.

7. A system according to claim 6, further comprising means for controlling the orifice such that the pressure within the reservoir is controlled.

8. An inkjet printer including an ink management system according claim 1 and including a printhead supplied with liquid from the ink management system.

9. An inkjet printer according to claim 8, wherein the printhead is the first remote location.

10. An inkjet printer according to claim 8, wherein the first chamber further comprises an outlet for supplying liquid to the printhead.

11. An inkjet printer including two ink management systems according to claim 1, wherein one system supplies liquid to a printhead and the other system receives liquid from the printhead, thereby controlling the pressure of the liquid supplied to the printhead and the pressure of the liquid removed from the printhead, such that the ink flows through the printhead at a controlled rate and at a controlled pressure.

12. An ink management system for supplying or receiving liquid at a controlled pressure, comprising:

a closed reservoir sealed from the surrounding atmosphere;

a weir disposed in the reservoir, configured to separate the reservoir into a first and a second chamber, the weir having a top being disposed at a location such that a level of liquid in the first chamber can be maintained at a constant height; the first chamber having an inlet for receiving liquid from a first remote location; and the second chamber having a pumped outlet at a position between a level of the weir and the bottom of the second chamber; and a pump coupled to the pumped outlet to remove liquid and gas contained within the reservoir.

13. A system according to claim 12, wherein the reservoir has an inlet and further comprises a pump coupled to an inlet to the reservoir in use, to pump gas into or out of the reservoir.

14. A system according to claim 12, wherein the reservoir has an orifice for allowing gas into or out of the reservoir.

* * * * *